US006102277A

United States Patent [19]

Krapohl, Sr.

[11] Patent Number: 6,102,277

[45] Date of Patent: Aug. 15, 2000

[54] REDUCIBLE CEREAL BOX PACKAGING

[76] Inventor: Robert J. Krapohl, Sr., 11 Cannon Dr., Hamilton Square, N.J. 08690

[21] Appl. No.: 09/360,409

[22] Filed: Jul. 23, 1999

[51] Int. Cl.[7] ..... B65D 5/355

[52] U.S. Cl. ..... 229/101.2; 229/117.35; 229/235

[58] Field of Search ..... 229/101, 101.1, 229/101.2, 117.35, 235

[56] References Cited

U.S. PATENT DOCUMENTS

| | | | |
|---|---|---|---|
| 1,751,755 | 3/1930 | Paris | 229/101.2 |
| 2,145,430 | 1/1939 | New | 229/235 |
| 2,658,664 | 11/1953 | Hennessey | 229/101.2 |
| 2,750,101 | 6/1956 | Jacke | 229/101.2 |
| 2,751,964 | 6/1956 | Guyer | 229/235 |
| 3,690,544 | 9/1972 | Meyers | 229/101.2 |
| 4,621,736 | 11/1986 | Roccaforte | 229/101.2 |

FOREIGN PATENT DOCUMENTS

| | | | |
|---|---|---|---|
| 453995 | 1/1949 | Canada | 229/101.2 |
| 107501 | 11/1924 | Switzerland | 229/235 |

*Primary Examiner*—Gary E. Elkins

[57] ABSTRACT

A reducible cereal box packaging for reducing the height of the cereal box as more and more cereal contained therein is consumed. The reducible cereal box packaging includes a box with a separation line extending therearound dividing the box into upper and lower portions. The box is separable along the separation line to permit separation of the upper and lower portions of the box and to define a lower opening in the upper portion of the box and a upper opening in the lower portion of the box. The upper edge of the lower portion is slidably insertable into the lower opening of the upper portion when the upper and lower portions are separated along the separation line.

7 Claims, 3 Drawing Sheets

REDUCIBLE CEREAL BOX PACKAGING

BACKGROUND OF THE INVENTION

1. Field of the Invention

The present invention relates to cereal box packaging and more particularly pertains to a new reducible cereal box packaging for reducing the height of the cereal box as more and more cereal contained therein is consumed.

2. Description of the Prior Art

The use of cereal box packaging is known in the prior art. More specifically, cereal box packaging heretofore devised and utilized are known to consist basically of familiar, expected and obvious structural configurations, notwithstanding the myriad of designs encompassed by the crowded prior art which have been developed for the fulfillment of Countless objectives and requirements.

Known prior art includes U.S. Pat. No. 1,751,755; U.S. Pat. No. 3,690,544; U.S. Pat. No. 5,251,808; U.S. Pat. No. 3,302,855; U.S. Pat. No. 3,680,766; U.S. Pat. No. 3,327,923; U.S. Pat. No. 3,310,220; U.S. Pat. No. 3,000,547; U.S. Pat. No. 2,329,297; and U.S. Pat. No. Des. 342,205.

While these devices fulfill their respective, particular objectives and requirements, the aforementioned patents do not disclose a new reducible cereal box packaging. The inventive device includes a box with a separation line extending therearound dividing the box into upper and lower portions. The box is separable along the separation line to permit separation of the upper and lower portions of the box and to define a lower opening in the upper portion of the box and a upper opening in the lower portion of the box. The upper edge of the lower portion is slidably insertable into the lower opening of the upper portion when the upper and lower portions are separated along the separation line.

In these respects, the reducible cereal box packaging according to the present invention substantially departs from the conventional concepts and designs of the prior art, and in so doing provides an apparatus primarily developed for the purpose of reducing the height of the cereal box as more and more cereal contained therein is consumed.

SUMMARY OF THE INVENTION

In view of the foregoing disadvantages inherent in the known types of cereal box packaging now present in the prior art, the present invention provides a new reducible cereal box packaging construction wherein the same can be utilized for reducing the height of the cereal box as more and more cereal contained therein is consumed.

The general purpose of the present invention, which will be described subsequently in greater detail, is to provide a new reducible cereal box packaging apparatus and method which has many of the advantages of the cereal box packaging mentioned heretofore and many novel features that result in a new reducible cereal box packaging which is not anticipated, rendered obvious, suggested, or even implied by any of the prior art cereal box packaging, either alone or in any combination thereof.

To attain this, the present invention generally comprises a box with a separation line extending therearound dividing the box into upper and lower portions. The box is separable along the separation line to permit separation of the upper and lower portions of the box and to define a lower opening in the upper portion of the box and a upper opening in the lower portion of the box. The upper edge of the lower portion is slidably insertable into the lower opening of the upper portion when the upper and lower portions are separated along the separation line.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new reducible cereal box packaging apparatus and method which has many of the advantages of the cereal box packaging mentioned heretofore and many novel features that result in a new reducible cereal box packaging which is not anticipated, rendered obvious, suggested, or even implied by any of the prior art cereal box packaging, either alone or in any combination thereof.

It is another object of the present invention to provide a new reducible cereal box packaging which may be easily and efficiently manufactured and marketed.

It is a further object of the present invention to provide a new reducible cereal box packaging which is of a durable and reliable construction.

An even further object of the present invention is to provide a new reducible cereal box packaging which is susceptible of a low cost of manufacture with regard to both materials and labor, and which accordingly is then susceptible of low prices of sale to the consuming public, thereby making such reducible cereal box packaging economically available to the buying public.

Still yet another object of the present invention is to provide a new reducible cereal box packaging which provides in the apparatuses and methods of the prior art some of the advantages thereof, while simultaneously overcoming some of the disadvantages normally associated therewith.

Still another object of the present invention is to provide a new reducible cereal box packaging for reducing the height of the cereal box as more and more cereal contained therein is consumed.

Yet another object of the present invention is to provide a new reducible cereal box packaging which includes a box with a separation line extending therearound dividing the box into upper and lower portions. The box is separable along the separation line to permit separation of the upper and lower portions of the box and to define a lower opening in the upper portion of the box and a upper opening in the lower portion of the box. The upper edge of the lower portion is slidably insertable into the lower opening of the upper portion when the upper and lower portions are separated along the separation line.

Still yet another object of the present invention is to provide a new reducible cereal box packaging that reduces the amount of space a cereal box occupies in a cupboard or a pantry.

Another object of the present invention is to help keep the plastic inner bag stay tightly rolled, thus keeping the product therein fresher than in current box designs. As a result, it would reduce wastage of the product, which would save consumers a considerable amount of money. Cereal would not be vulnerable to insects, tampering, or moisture that causes cereals to become soggy.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
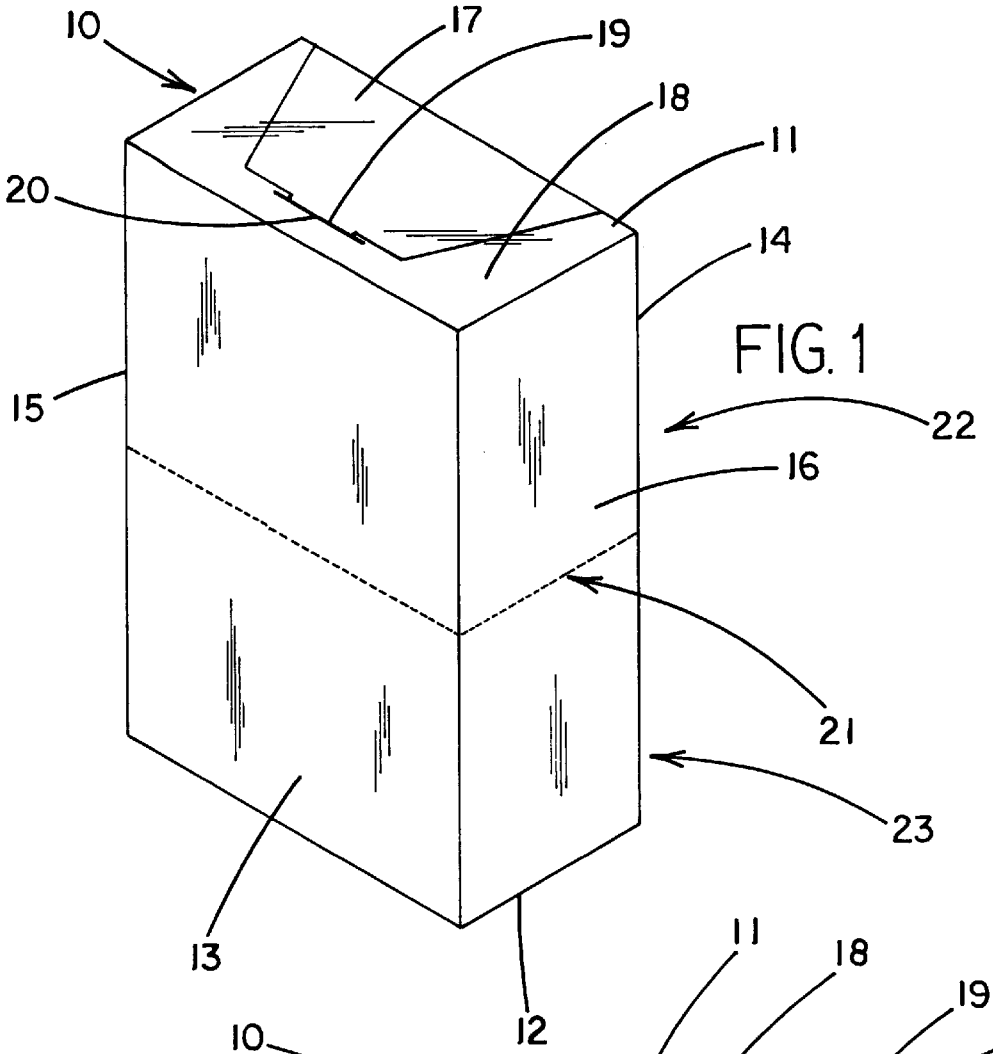
FIG. 1 is a schematic front perspective view of a new reducible cereal box packaging with the upper and lower portions of the box not yet separated according to the present invention.

With reference now to the drawings, and in particular to FIGS. 1 through 5 thereof, a new reducible cereal box packaging embodying the principles and concepts of the present invention will be described.

As best illustrated in FIGS. 1 through 5, the reducible cereal box packaging generally comprises a box with a separation line extending therearound dividing the box into upper and lower portions. The box is separable along the separation line to permit separation of the upper and lower portions of the box and to define a lower opening in the upper portion of the box and a upper opening in the lower portion of the box. The upper edge of the lower portion is slidably insertable into the lower opening of the upper portion when the upper and lower portions are separated along the separation line.

In closer detail, the reducible cereal box packaging comprises a generally rectangular box 10 comprising a cardboard material and having spaced apart and substantially parallel generally rectangular top and bottom panels 11,12, spaced apart and substantially parallel generally rectangular front and back panels 13,14, and a pair of spaced apart and substantially parallel generally rectangular side panels 15,16.

The front, back, and side panels of the box are extended substantially perpendicular to the top and bottom panels of the box. The front and back panels of the box are extended substantially perpendicular to the side panels of the box.

Preferably, the top panel of the box comprises a pair of flaps 17,18 substantially covering a top opening into the box. One of the flaps has a tab 19 and the other flap has a slot 20 receiving the tab to hold the flaps of the top panel together in a closed position over the top opening of the box.

The box has a generally rectangular separation line 21 extending around the front, back and side panels of the box. The separation line of the box preferably lies in a plane substantially parallel to the top and bottom panels of the box. Ideally, the plane of the separation lie of the is generally equidistantly positioned between the top and bottom panels of the box.

The separation line of the box divides the box into upper and lower portions 22,23. The upper portion of the box comprises the top panel of the box and upper regions of the front, back and side panels. The lower portion of the box comprises the bottom panel of the box and lower regions of the front, back and side panels. The box is separable along the separation line to permit separation of the upper and lower portions of the box. Preferably, the front, back and side panels of the box each have a plurality of apertures or perforations 24 along the separation line to aid separation of the box along the separation line.

The separation line forms a generally rectangular upper edge of the lower portion along the lower regions of the front, back and side panels and a generally rectangular lower edge 26 of the upper portion of the box along the upper regions of the front, back and side panels of the box. The lower edge of the upper portion defines a generally rectangular lower opening into the upper portion of the box. The upper edge of the lower portion defines a generally rectangular upper opening into lower portion of the box.

Figure 2:
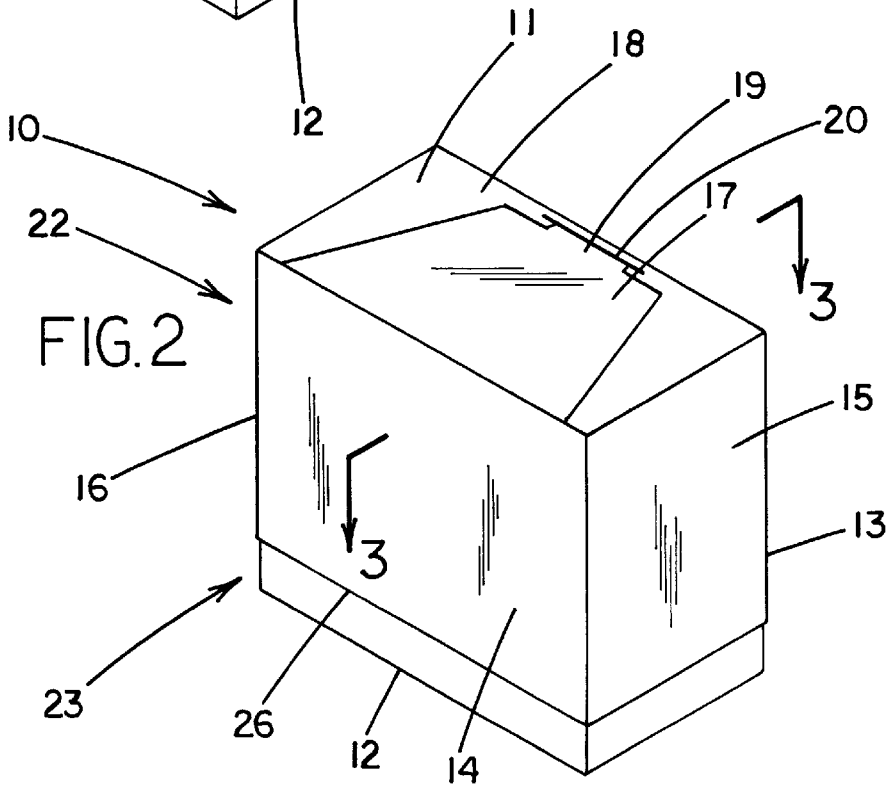
FIG. 2 is a schematic back perspective view of the present invention with the upper and lower portions of the box separated and the lower portion of the box slidably inserted into the lower opening of the upper portion of the box.
Figure 3:
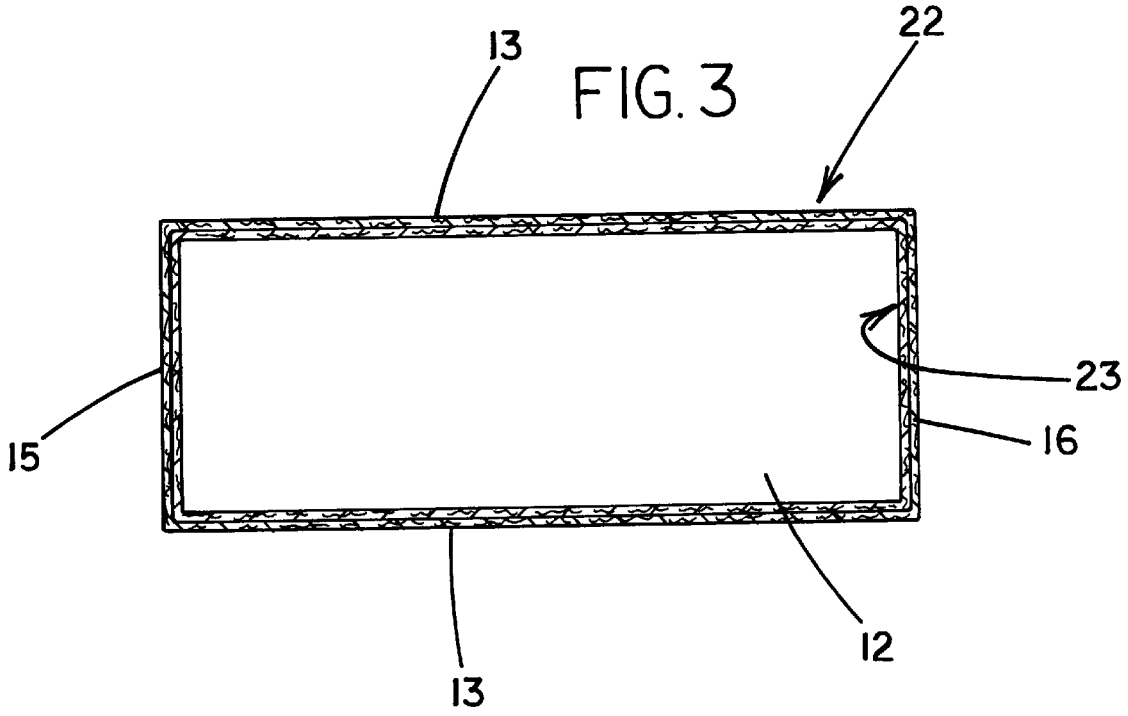
FIG. 3 is a schematic cross sectional view of the present invention taken from line 3—3 of FIG. 2 and looking downwards towards the bottom panel of the box.
Figure 4:
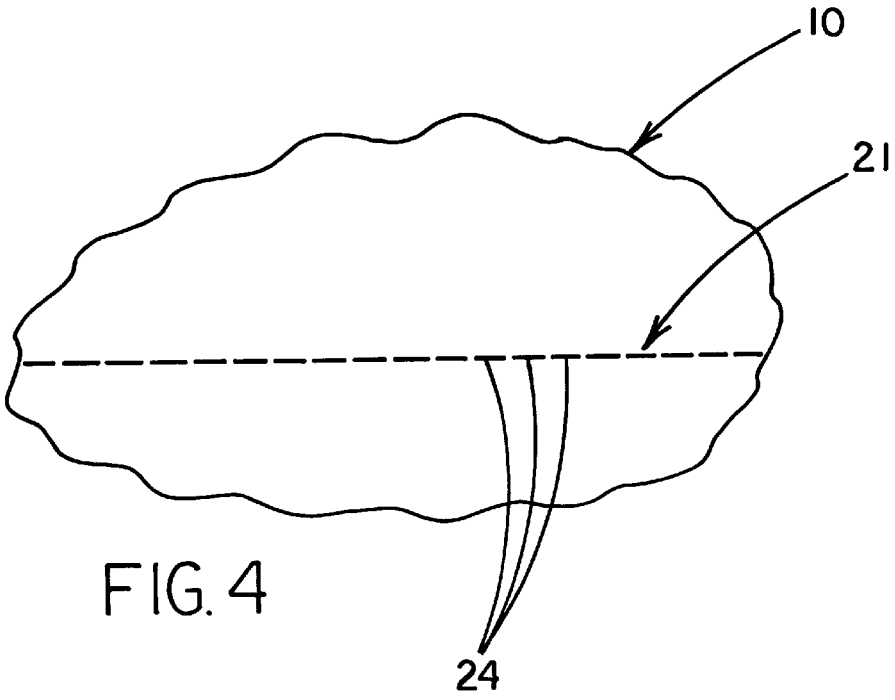
FIG. 4 is a schematic enlarged partial side view of the perforations of the separation line.
Figure 5:
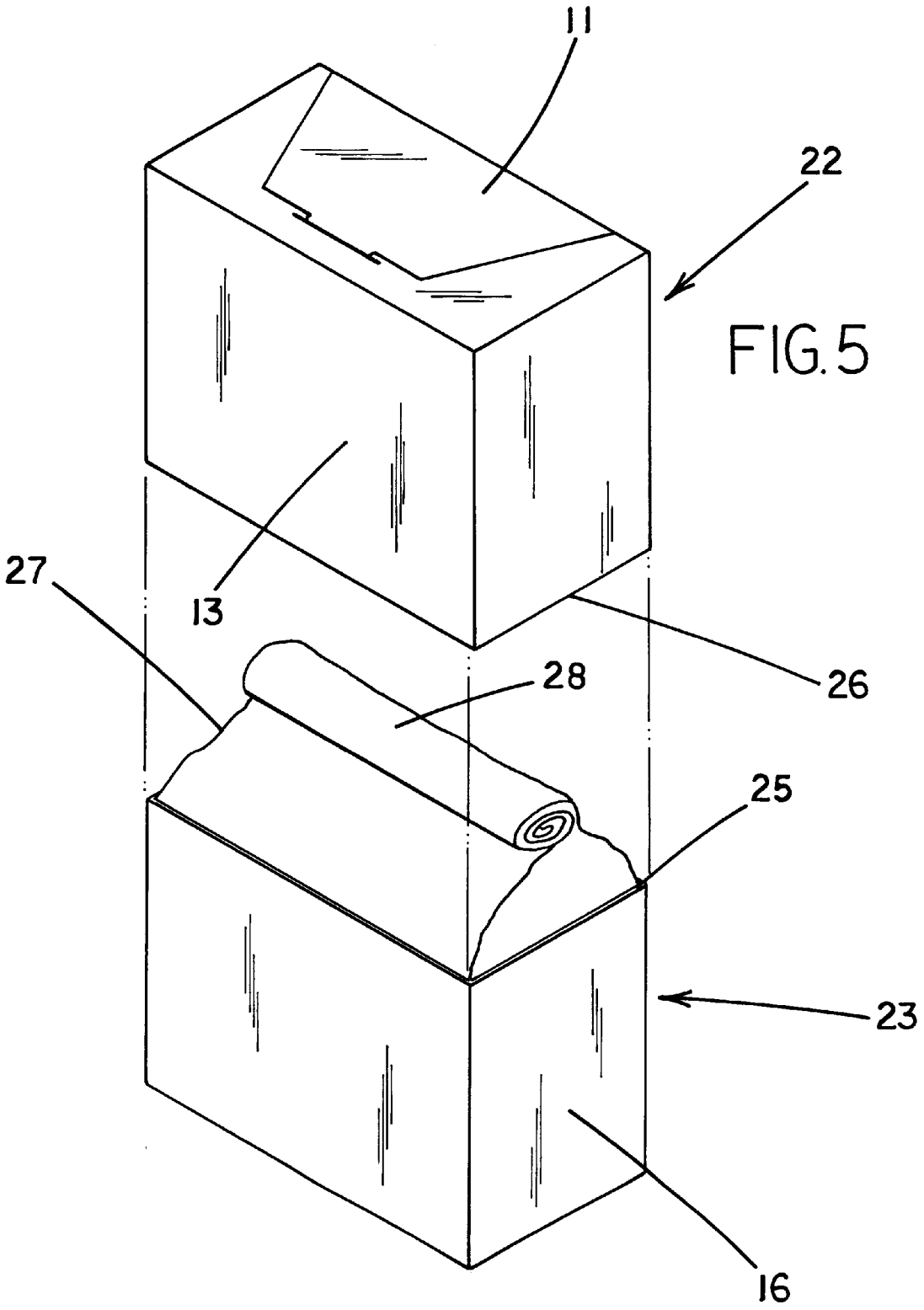
FIG. 5 is a schematic exploded front perspective view of the present invention illustrating the bag in the box.

As best illustrated in FIG. 2, the upper edge of the lower portion is slidably inserted into the lower opening of the upper portion by slight bending inwards of the lower regions of the panels of the lower portion due to the flexible properties of the cardboard material of the box. This way, the upper portion of the box telescopically receives the lower portion of the box so that the upper and lower portions of the box may be slid closer together and further apart from one another to adjust the overall height of the box defined between the top and bottom panels of the box.

Preferably, a flexible bag 27 is disposed in the box. The bag has a bottom located in the lower portion of the box adjacent the bottom panel and an upper mouth or opening located in the upper portion of the box adjacent the top panel. In use, the bag is designed for holding particular material such as cereal therein. The upper mouth of the bag is rollable into a roll 28 to close the upper mouth of the bag as cereal is removed from the bag. The rolling of the upper mouth reduces the overall height of the bag as the amount of cereal in the bag (and thus the box) is reduced by consumption.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An article of manufacture, comprising:

a box having a separation line extending therearound and dividing said box into upper and lower portions;

said box being separable along said separation line to permit separation of said upper and lower portions of said box and to define a lower opening in said upper portion of said box and a upper opening in said lower portion of said box, wherein said upper edge of said lower portion being slidably insertable into said lower opening of said upper portion when said upper and lower portions are separated along said separation line, said upper and lower portions are separated such that said upper portion of said box telescopically receives said lower portion of said box so that said upper and lower portions of said box may be slid closer together and further apart from one another to adjust the overall height of said box defined between said top and bottom panels of said box; and said top panel of said box comprising a pair of flaps substantially covering a top opening into said box, one of said flaps having a tab and the other of said flaps having a slot receiving said tab to hold said flaps of said top panel together in a closed position over said top opening of said box such that said top panel of said box can be easily opened without removing said upper portion from said lower portion.

2. The article of manufacture of claim 1, wherein said box has top, bottom, front, back and a pair of side panels, said separation line being extended around said front, back and side panels of said box.

3. The article of manufacture of claim 2, wherein said separation line, said top panel and said bottom panel of said box lie in substantially parallel planes with one another.

4. The article of manufacture of claim 3, wherein said plane of said separation lie is generally equidistantly positioned between said top and bottom panels of said box.

5. The article of manufacture of claim 1, wherein said box has a plurality of perforations along said separation line to aid separation of said box along said separation line.

6. The article of manufacture of claim 1, further comprising a flexible bag being disposed in said box, said bag having a bottom located in said lower portion of said box adjacent said bottom panel and an upper mouth located in said upper portion of said box adjacent said top panel, said bag being adapted for holding particular material therein, said upper mouth of said bag being rollable into a roll to close said upper mouth of said bag.

7. An article of manufacture, comprising:

a generally rectangular box having spaced apart and substantially parallel generally rectangular top and bottom panels, spaced apart and substantially parallel generally rectangular front and back panels, and a pair of spaced apart and substantially parallel generally rectangular side panels;

said front, back, and side panels of said box being extended substantially perpendicular to said top and bottom panels of said box, said front and back panels of said box being extended substantially perpendicular to said side panels of said box;

said top panel of said box comprising a pair of flaps substantially covering a top opening into said box, one of said flaps having a tab and the other of said flaps having a slot receiving said tab to hold said flaps of said top panel together in a closed position over said top opening of said box such that said top panel of said box can be easily opened without removing said upper portion from said lower portion;

said box having a generally rectangular separation line extending around said front, back and side panels of said box;

said separation line of said box lying in a plane substantially parallel to said top and bottom panels of said box, said plane of said separation lie of said being generally equidistantly positioned between said top and bottom panels of said box;

said separation line of said box dividing said box into upper and lower portions, said upper portion of said box comprising said top panel of said box and upper regions of said front, back and side panels, said lower portion of said box comprising said bottom panel of said box and lower regions of said front, back and side panels;

said box being separable along said separation line to permit separation of said upper and lower portions of said box;

wherein said front, back and side panels of said box each have a plurality of perforations along said separation line to aid separation of said box along said separation line;

said separation line forming a generally rectangular upper edge of said lower portion along said lower regions of said front, back and side panels and a generally rectangular lower edge of said upper portion of said box along said upper regions of said front, back and side panels of said box;

said lower edge of said upper portion defining a generally rectangular lower opening into said upper portion of said box, said upper edge of said lower portion defining a generally rectangular upper opening into lower portion of said box;

said upper edge of said lower portion being slidably inserted into said lower opening of said upper portion by slightly bending inwards of said lower regions of said panels of said box when said upper and lower portions are separated such that said upper portion of said box telescopically receives said lower portion of said box so that said upper and lower portions of said box may be slid closer together and further apart from one another to adjust the overall height of said box defined between said top and bottom panels of said box; and a flexible bag being disposed in said box, said bag having a bottom located in said lower portion of said box adjacent said bottom panel and an upper mouth located in said upper portion of said box adjacent said top panel, said bag being adapted for holding particular material therein, said upper mouth of said bag being rollable into a roll to close said upper mouth of said bag.

* * * * *